United States Patent [19]

Christian, III

[11] Patent Number: 4,534,672

[45] Date of Patent: Aug. 13, 1985

[54] HUB FOR GEODESIC DOME CONSTRUCTION

[76] Inventor: James E. Christian, III, Rte. 2, Box 274, McKinney, Tex. 75069

[21] Appl. No.: 582,822

[22] Filed: Feb. 23, 1984

[51] Int. Cl.[3] ..... E04B 1/32

[52] U.S. Cl. ..... 403/172; 52/81; 403/176

[58] Field of Search ..... 52/80, 81, 82; 403/171, 403/172, 175, 174, 178, 176, 170

[56] References Cited

U.S. PATENT DOCUMENTS

| | | | |
|---|---|---|---|
| 2,535,263 | 12/1950 | Budne | 403/173 |
| 2,868,568 | 1/1959 | Frye | 403/171 |
| 3,002,590 | 10/1961 | Hannoosh et al. | 189/1 |
| 3,186,522 | 6/1965 | McCauley | 189/1 |
| 3,486,278 | 12/1969 | Woods | 52/81 |
| 3,635,509 | 1/1972 | Birkemeier et al. | 287/189.36 C |
| 3,810,342 | 5/1974 | Scott | 52/758 R |
| 3,990,195 | 11/1976 | Gunther | 52/81 |
| 4,247,218 | 1/1981 | Jeannin | 52/81 |
| 4,260,276 | 4/1981 | Phillips | 52/80 |
| 4,262,461 | 4/1981 | Johnson et al. | 52/81 |
| 4,365,910 | 12/1982 | Ford | 403/172 |
| 4,395,154 | 7/1983 | Phillips | 52/80 |
| 4,432,661 | 2/1984 | Phillips | 52/80 |
| 4,464,073 | 8/1984 | Cherry | 52/81 |

FOREIGN PATENT DOCUMENTS

| | | | |
|---|---|---|---|
| 3137202 | 5/1983 | Fed. Rep. of Germany | 52/80 |
| 2526890 | 11/1983 | France | 403/170 |

*Primary Examiner*—Henry E. Raduazo

*Attorney, Agent, or Firm*—Hubbard, Thurman, Turner & Tucker

[57] ABSTRACT

A hub for use in the construction of geodesic domes is disclosed. The hub is formed from a plurality of pairs of elongate plate members. Each pair of elongate plate members includes two elongate plate members of dissimilar length, each having a circular orifice located a selected distance from one end thereof. The two elongate plate members are disposed in spaced apart parallel relationship and adapted to receive and restrain an elongate wooden strut therebetween utilizing a bolt threaded through the circular orifices. Each of the pairs of elongate plate members is then interconnected at at least three points with the remaining pairs of elongate plate members to form a central junction having increased structural reliability due to the multiple interconnection points. A preferred embodiment of the hub is constructed by welding together a plurality of elongate metal plates.

7 Claims, 5 Drawing Figures

HUB FOR GEODESIC DOME CONSTRUCTION

BACKGROUND OF THE INVENTION

This invention relates in general to devices for joining a plurality of struts or beams at a common vertex and more particularly to hubs for use in the construction of geodesic dome structures.

A class of structures which demonstrate stability without internal or external supports other than the mounting base are typically referred to as "space frame" or "geodesic" structures. These structures were first described by R. Buckminster Fuller, U.S. Pat. No. 2,682,235, and have come into general use for housing exhibitions, athletic stadia and swimming pools. Recently, the low construction cost and high stability of geodesic domes has resulted in their growing acceptance as personal residences.

The increased utilization of geodesic dome construction techniques has resulted in a demand for simpler and less expensive techniques for joining the multiple struts of such a structure to a common vertex. Numerous patents have issued describing various alternate hubs or strut connectors which may be utilized to form the various triangles and other shapes necessary to construct a geodesic dome. While generally acceptable, these structures are typically either expensive to construct or else susceptible to material failure under stress. It should therefore be apparent that a need exists for a hub structure which is relatively inexpensive to construct and demonstrates increased reliability under stress.

SUMMARY OF THE INVENTION

It is therefore one object of the present invention to provide an improved hub for joining a plurality of struts at a common vertex.

It is another object of the present invention to provide an improved hub for joining a plurality of struts at a common vertex which is relatively simple and inexpensive to construct.

It is yet another object of the present invention to provide an improved hub for joining a plurality of struts at a common vertex which contains redundant structural members and joints which render the hub more reliable under stress.

It is another object of the present invention to provide an improved hub for joining a plurality of struts at a common vertex which permits the struts to be joined at varying angles from the plane in which the vertex lies.

The foregoing objects are achieved as is now described. The hub of the present invention is formed from a plurality of pairs of elongate plate members. Each pair of elongate plate members includes two elongate plate members of dissimilar length, each having at least one circular orifice located a selected distance from one end thereof. The two elongate plate members are disposed in spaced apart parallel relationship and adapted to receive and restrain an elongate wooden strut therebetween utilizing a bolt threaded through the circular orifices. Each of the pairs of elongate plate members is then interconnected at at least three points with the remaining pairs of elongate plate members to form a central junction having increased structural reliability due to the multiple interconnection points. A preferred embodiment of the hub is constructed by welding together a plurality of elongate metal plates.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
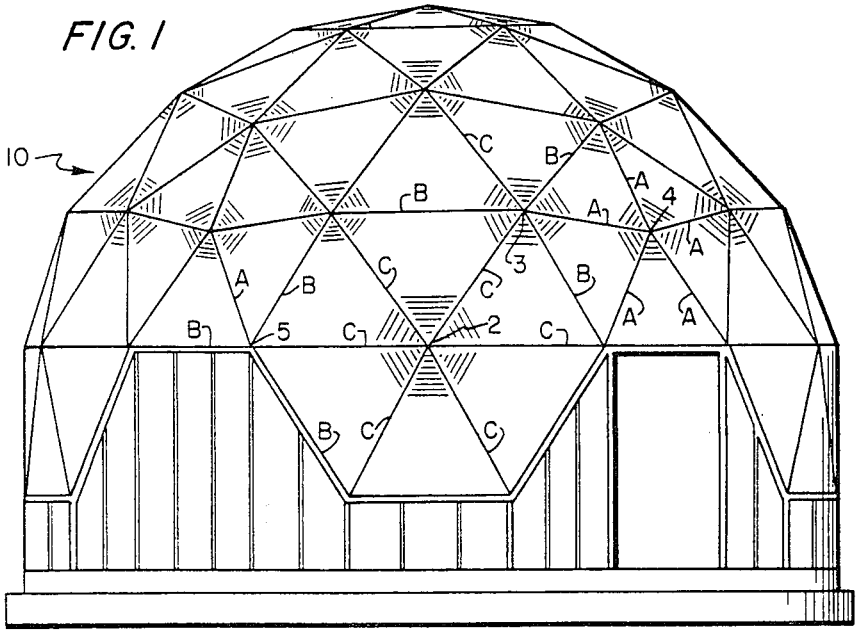
FIG. 1 is an elevation view of a geodesic dome of the type which may be constructed with the novel hub of the present invention.

Referring now to the figures, and in particular to FIG. 1, there is depicted an elevation view of a geodesic dome of the type which may be constructed with the novel hub of the present invention. As can be seen, dome 10 is a network of struts which are interconnected to form a portion of a convex polyhedron. The struts of dome 10 are interconnected so that each section of dome 10 appears to be a triangle which abuts another triangle, with the abutting sides being equal in length.

It is an integral feature of geodesic dome design that each vertex if a triangle is therefore a common vertex for several other triangles. Thus, multiple struts or beams must be interconnected at each such hub to form the depicted structure. Of course, those skilled in the art will appreciate that the number of hubs and the angles between adjacent struts at each hub will vary according to the type and shape of dome under construction.

The depicted dome 10 is based upon a three-frequency icosahedron, that is, each of the twenty triangles forming the surface of the icosahedron is divided into nine triangles formed by two lines parallel to each side of the triangle and spaced so that the altitude of each side is divided into three equal segments. In order to facilitate the following discussion of the novel hub of the present invention, the examples of hubs depicted will be assumed to be utilized in reference to a dome based upon a three frequency iscosahedron.

Those skilled in the art will appreciate that dome 10 may be constructed utilizing three repetitive strut lengths which are labeled, in a convention common in the construction of geodesic domes, strut A, strut B and strut C. Thus, upon reference to FIG. 1, it should be apparent that several different hub forms will be necessary to construct the numerous vertices present in dome 10.

For example, at point 2 of dome 10, a vertex is formed having six identical C struts which are spaced equidistant, that is, sixty degrees between each pair of adjacent struts. The vertex formed at point 3 of dome 10 also includes six struts; however, this vertex utilizes three B struts, two C struts and a single A strut and employs spacing between adjacent struts of either 56 degrees or 62 degrees.

The vertex formed at point 4 of dome 10 forms a common juncture for five A struts and employs an equal angle spacing of 72 degrees between adjacent struts. Finally, there are various special or odd vertices such as the vertex formed at point 5 of dome 10, where dome 10 intersects a base wall or support member in an irregular manner.

Figure 2:
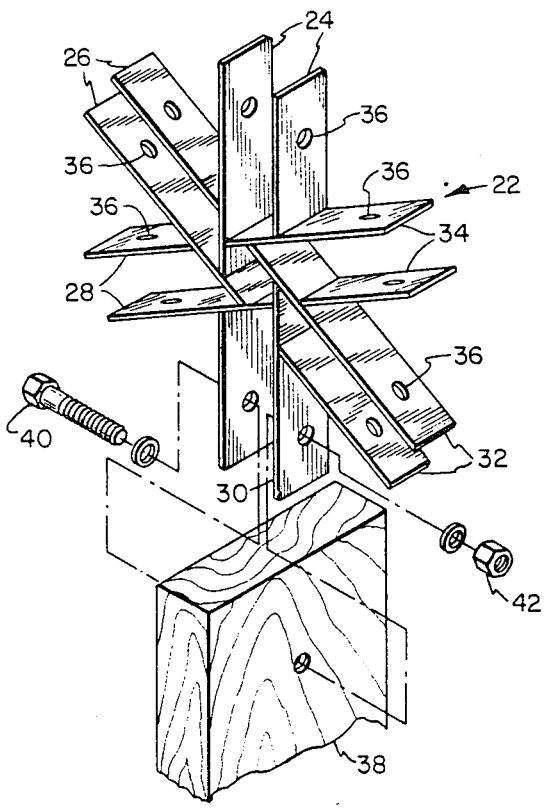
FIG. 2 is an exploded perspective view showing one embodiment of the novel hub of the present invention and means for interconnecting the hub to a strut.

Referring now to FIG. 2, there is depicted an exploded perspective view showing one embodiment of novel hub 22 of the present invention and means for interconnecting hub 22 to a strut. Hub 22 is a suitable hub for implementing the vertex at point 2 on dome 10. As can be seen, hub 22 includes multiple pairs of elongate plate members 24, 26, 28, 30, 32 and 34. Each pair of elongate plate members comprises two plate members of dissimilar length, each having an orifice 36 disposed a selected distance from the outer end thereof. As a numbering convention in the following discussion, in each case, the shorter of each pair of plate members will be referred to with the added designation "A" and the longer plate member with the added designation "B." That is, plate member 26B will refer to the longer of the two plate members forming pair 26.

As is illustrated, hub 22 can be utilized to join a plurality of struts such as strut 38, which may be formed of a light metal or elongate wooden beams, such as a two inch by six inch wood beam. An appropriate aperture is drilling into the end of strut 38 and a threaded bolt 40 may be utilized in conjunction with nut 42 to fasten strut 38 between planar members 30A and 30B. As should be appreciated by those skilled in this art, it is a simple matter to pivot strut 38 about bolt 40 to achieve the precise angular displacement desired prior to tightening nut 42. Thus, hub 22 may be utilized for the construction of domes of varying sizes and shapes without modifying the construction techniques utilized to implement hub 22.

In the depicted embodiment of hub 22, each pair of plate members is constructed utilizing a pair of elongate metal plates of dissimilar length, preferably of durable material such as iron, aluminum, steel or other alloys. Each pair of plate members is aligned in spaced apart parallel relationships so that orifice 36 of one plate member will align with orifice 36 of the other plate member. Of course, orifice 36 can be provided with a slightly larger diameter than bolt 40 to accommodate slight irregularities in alignment.

Each pair of plate members is then interconnected with the remaining pairs of plate members in the manner depicted to form a common junction. The advantage of this construction technique over known techniques involves the multiplicity of joint areas involved. For example, plate member 24A is interconnected into the common junction by fastening plate member 24A to plate member 34B, preferably by welding or other permanent techniques. In comparison, plate member 24B is fastened into the common junction at three points. Specifically, at the intersections of plate member 24B with plate members 26A, 26B and 34B. Therefore, pair of elongate plate members 24 is fastened into the common junction of hub 22 at four different points. In this manner, should the material or welded joint fail at any one of several points within 22, the hub will retain its structural integrity, unlike known hub connectors.

Figure 3:
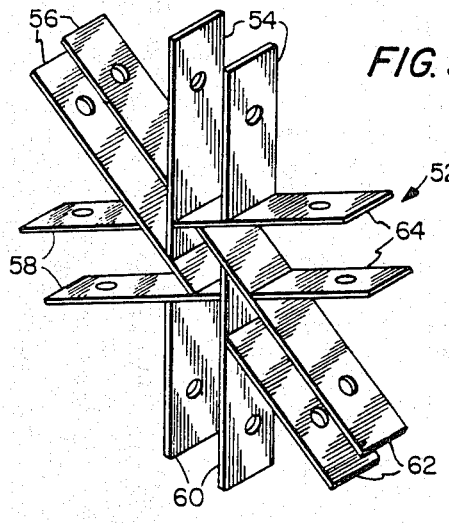
FIG. 3 depicts a perspective view of an alternate embodiment of the novel hub of the present invention.
Figure 4:
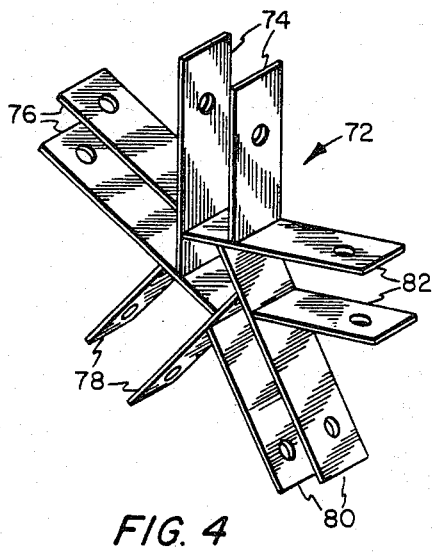
FIG. 4 depicts a perspective view of an alternate embodiment of the novel hub of the present invention.

In a similar manner, FIGS. 3 and 4 depict hubs 52 and 72 which are constructed in the manner of the present invention and which are suitable for providing the vertices found at points 3 and 4 respectively, of dome 10 (see FIG. 1). In each depicted hub, a plurality of pairs of plate members of dissimilar length are interconnected to form a common junction with multiple connection points being provided along the length of each of the longer of each pair of plate members.

Figure 5:
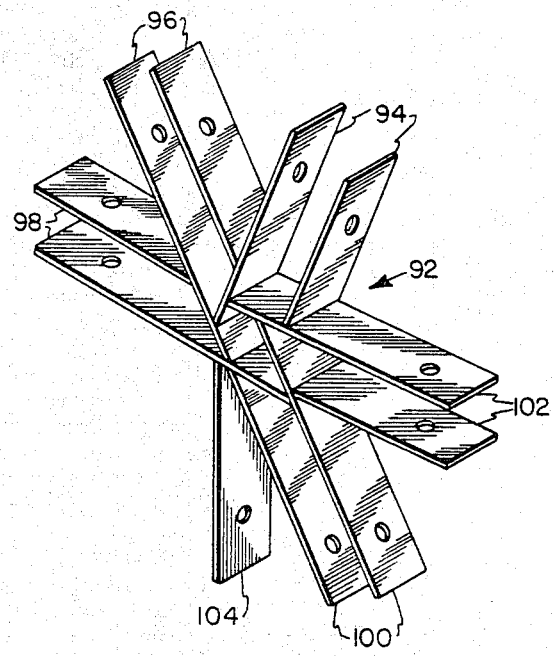
FIG. 5 depicts a perspective view of an alternate embodiment of the novel hub of the present invention.

Finally, FIG. 5 depicts hub 92 which is suitable for providing the vertex present at point 5 of FIG. 1. Hub 92 is constructed in an identical manner to the hubs described above, with the addition of an additional plate member 104 which may be utilized to join hub 92 to a base wall or support member as desired.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. For example, while the specific embodiment of the novel hub of the present invention is disclosed as constructed utilizing individual plate members, it is within the scope of the present invention to form the hub utilizing a cast or molded device wherein the multiple interconnection points of the present invention are also demonstrated. It is therefore contemplated that the appended claims will cover any such modifications or embodiments that fall within the true scope of the invention.

What I claim is:

1. A hub for use in the construction of geodesic domes comprising:

a plurality of pairs of elongate plate members, each of said plurality of pairs of elongate plate members comprising two elongate plate members of dissimilar length, each having an orifice disposed a selected distance from one end thereof, each of said two elongate plate members being disposed in spaced apart parallel relationship, one with the other, with said orifice in one elongate plate member being aligned with said orifice in the other elongate plate member, and each of said pairs of elongate plate members being interconnected at at last three points with said plurality of pairs of elongate plate members wherein a central junction is formed with said plurality of pairs of elongate plate members extending outward therefrom.

2. The hub for use in the construction of geodesic domes according to claim 1 wherein each of said elongate plate members comprises a metal plate.

3. The hub for use in the construction of geodesic domes according to claim 2 wherein each of said elongate plate members comprises a steel plate.

4. The hub for use in the construction of geodesic domes according to claim 1 wherein said orifice in each elongated plate member comprises a circular orifice adapted to receive a threaded bolt.

5. The hub for use in the construction of geodesic domes according to claim 1 wherein each of said elongate pairs of plate members of dissimilar length is interconnected at four points with said plurality of elongate plate members.

6. The hub for use in the construction of geodesic domes according to claim 5 wherein the longer of said two elongate plate members of dissimilar length is interconnected with said plurality of pairs of elongate plate members at three points and wherein the shorter of said two elongate plate members is interconnected with said plurality of elongate plate members at a single point.

7. The hub for use in the construction of geodesic domes according to claim 2 wherein each of said pairs of elongate plate members is interconnected with said plurality of pairs of elongate plate members by welding at at least three points.

* * * * *

UNITED STATES PATENT AND TRADEMARK OFFICE

CERTIFICATE OF CORRECTION

PATENT NO. : 4,534,672

DATED : August 13, 1985

INVENTOR(S) : James E. Christian, III

It is certified that error appears in the above-identified patent and that said Letters Patent is hereby corrected as shown below:

Column 2, line 38, "if" should be --of--.
Column 4, line 44, Claim 1, "last" should be --least--.

Signed and Sealed this

*Tenth* Day of *December 1985*

[SEAL]

*Attest:*

DONALD J. QUIGG

*Attesting Officer*

*Commissioner of Patents and Trademarks*